US009955752B2

(12) United States Patent
Ito et al.

(10) Patent No.: US 9,955,752 B2
(45) Date of Patent: May 1, 2018

(54) SOLE STRUCTURE FOR A BASEBALL SPIKED SHOE

(71) Applicant: Mizuno Corporation, Osaka-shi (JP)

(72) Inventors: Koji Ito, Takaishi (JP); Shin Hirai, Himeji (JP); Tsuyoshi Ieta, Osaka (JP)

(73) Assignee: Mizuno Corporation, Osaka-shi (JP)

( * ) Notice: Subject to any disclaimer, the term of this patent is extended or adjusted under 35 U.S.C. 154(b) by 38 days.

(21) Appl. No.: 15/201,821

(22) Filed: Jul. 5, 2016

(65) Prior Publication Data

US 2017/0013913 A1 Jan. 19, 2017

(30) Foreign Application Priority Data

Jul. 17, 2015 (JP) ..... 2015-142640

(51) Int. Cl.

| | |
|---|---|
| ***A43B 13/18*** | (2006.01) |
| ***A43B 13/12*** | (2006.01) |
| ***A43B 5/00*** | (2006.01) |
| ***A43C 15/16*** | (2006.01) |
| ***A43B 13/04*** | (2006.01) |
| ***A43B 7/14*** | (2006.01) |
| ***A43B 21/26*** | (2006.01) |

(52) U.S. Cl.

CPC ..... *A43B 13/186* (2013.01); *A43B 5/00* (2013.01); *A43B 7/144* (2013.01); *A43B 7/148* (2013.01); *A43B 13/04* (2013.01); *A43B 13/125* (2013.01); *A43B 13/184* (2013.01); *A43B 13/188* (2013.01); *A43B 21/26* (2013.01); *A43C 15/161* (2013.01)

(58) Field of Classification Search

CPC ... A43B 13/181; A43B 13/186; A43B 13/125; A43B 13/188; A43B 7/144; A43B 7/148; A43B 21/26

USPC ..... 36/27, 28, 35 R

See application file for complete search history.

(56) References Cited

U.S. PATENT DOCUMENTS

| | | | | |
|---|---|---|---|---|
| 1,920,112 A * | 7/1933 | Shaft | ..... | A43B 21/32 36/28 |
| 5,787,609 A * | 8/1998 | Wu | ..... | A43B 21/28 36/28 |
| 5,933,983 A * | 8/1999 | Jeon | ..... | A43B 21/28 36/27 |
| 6,050,001 A * | 4/2000 | Ditrtrich | ..... | A43B 7/144 36/108 |

(Continued)

FOREIGN PATENT DOCUMENTS

JP 08-084605 A 4/1996

*Primary Examiner* — Ted Kavanaugh

(74) *Attorney, Agent, or Firm* — W. F. Fasse

(57) ABSTRACT

A simplified sole structure for a baseball spiked shoe can improve cushioning properties of a heel region of the sole structure and can enhance comfort when wearing the shoe. The baseball spiked shoe includes a first midsole of a soft elastic member that is disposed at a heel central portion of the shoe, a second midsole of a soft elastic member that is disposed around and outwardly e.g. horizontally away from the first midsole via a circumferential groove therebetween and that is integrated with or unitary as one unit with the first midsole, and an outsole plate of a hard elastic member that is disposed on lower surfaces of the first and second midsoles, that has a plurality of spikes fitted thereon, and that has a hardness greater than a respective hardness of each of the first and second midsoles.

10 Claims, 10 Drawing Sheets

(56) References Cited

U.S. PATENT DOCUMENTS

| | | | | |
|---|---|---|---|---|
| 6,115,944 | A * | 9/2000 | Lain | A43B 21/26 36/28 |
| 9,456,658 | B2 * | 10/2016 | Bruce | A43B 13/20 |
| 2003/0029060 | A1 * | 2/2003 | Hockerson | A43B 5/02 36/67 R |
| 2005/0160626 | A1 * | 7/2005 | Townsend | A43B 7/144 36/30 R |
| 2005/0268490 | A1 * | 12/2005 | Foxen | A43B 7/1425 36/28 |
| 2006/0156581 | A1 * | 7/2006 | Holden | A43B 7/1425 36/29 |
| 2006/0265907 | A1 * | 11/2006 | Sommer | A43B 13/189 36/28 |
| 2016/0278481 | A1 * | 9/2016 | Le | A43B 13/188 |

* cited by examiner

SOLE STRUCTURE FOR A BASEBALL SPIKED SHOE

BACKGROUND OF THE INVENTION

The present invention relates generally to a sole structure for a baseball spiked shoe, and more particularly, to improvement in structure of said sole structure.

Japanese patent application publication No. 1996-84605 discloses a sole for a sports shoe in which a through hole with an annular engagement portion is formed at a heel portion of the sole and a cushioning member of a diameter greater than an inner diameter of the through hole is detachably inserted into the through hole (see paras. [0021]-[0025], [0029] and FIG. 9).

According the description of the above publication, since the cushioning member is translatable upwardly and downwardly inside the through hole, when a sole body receives a ground impact force at time of impact onto the ground the cushioning member expands and contracts vertically independently of the sole body to absorb the impact thereby increasing a ground impact effect of the heel portion (see para. [0031]).

However, in the structure described in the above publication, it tries to absorb the ground impact force by expansion and contraction in a vertical direction of the cushioning member. Owing to that, in order to prevent the cushioning member from falling out of the through hole at the time of expansion and contraction of the cushioning member and also to prevent an upper end of the cushioning member from protruding from the through hole, a plurality of annular engagement portions are required to be formed in the through hole and a plurality of longitudinal grooves that engage with these annular engagement portions are required to be formed in the cushioning member, which makes the structure complicated. Moreover, a gel-like substance as the cushioning member should be provided under a solid member with a longitudinal groove thus making the structure more complicated.

The present invention has been made in view of these circumstances and its object is to provide a simplified sole structure for a baseball spiked shoe that can improve cushioning properties of a heel region of the structure and that can enhance comfortableness in wearing the shoe.

Other objects and advantages of the present invention will be obvious and appear hereinafter.

SUMMARY OF THE INVENTION

A sole structure for a baseball spiked shoe according to the present invention includes a first midsole disposed at a heel central portion of the shoe, a second midsole that is disposed around and away from the first midsole via a circumferential groove and that is integrated with or unitary as one unit with the first midsole, and an outsole that is disposed under the first and second midsoles, that has a plurality of spikes fitted thereon, and that has a hardness greater than a hardness of each of the first and second midsoles.

According to the present invention, when a heel of the shoe strikes onto the ground, a load from a heel portion of a shoe wearer's foot is imparted to the first and second midsoles with the spikes of the outsole contacted with the ground and a heel region of the shoe supported. At this moment, the first midsole disposed at the heel central portion of the shoe expands outwardly e.g. horizontally toward the circumferential groove to compressively deform, thereby absorbing an impact force at the time of impact onto the ground, improving cushioning properties of the heel region of the shoe, and thus enhancing comfortableness in wearing the shoe. In the present invention, the entire sole structure can be simplified by merely separating the first midsole at the heel central portion from the second midsole around the first midsole via the circumferential groove.

Moreover, since the first midsole is integrated with or unitary as one unit with the second midsole, when the first midsole deforms, a fall-off, a protrusion or the like of the first midsole from the second midsole can be securely prevented without any special structures. Here, in the specification, "to be integrated with" means that different two members are coupled to each other, and "to be unitary as one unit with" means that a single member is overall formed with two portions, that is, a member that has originally been a single one is separated into two sections.

The first midsole may be integrated with and received by the second midsole in a cavity formed in a lower surface of the second midsole, the circumferential groove may be formed by an outer circumferential surface of the first midsole and an inner circumferential surface of the cavity of the second midsole, and a lower surface of the first midsole may not protrude from the lower surface of the second midsole.

In this case, by the feature that the lower surface of the first midsole does not protrude from the lower surface of the second midsole, when the heel of the shoe strikes onto the ground, the heel portion of the foot can be stably supported by the entire heel region of the shoe, such that thereby allowing for a circumferentially equal outward deformation of the first midsole. As a result of this, a lateral swing of the heel portion of the foot at the time of impact onto the ground can be prevented.

The first midsole may be located at a position corresponding to a bottom protruding portion of a calcaneus of the shoe wearer's foot.

An inner circumferential surface of the circumferential groove may be positioned at a region of a concentric circle with a position corresponding to a heel center of the shoe wearer's foot as a center of the circle and with a diameter of 40 mm or more but less than 60 mm.

The circumferential groove may be an annular groove that extends along an entire periphery around the position corresponding to the heel center of the shoe wearer's foot.

The circumferential groove may be formed of a plurality of grooves that extend linearly or curvedly around the position corresponding to the heel center of the shoe wearer's foot.

A hardness of the first midsole may be lower than a hardness of the second midsole.

BRIEF DESCRIPTION OF THE DRAWINGS

For a more complete understanding of the invention, reference should be made to the embodiments illustrated in greater detail in the accompanying drawings and described below byway of examples of the invention. In the drawings, which are not to scale.

DETAILED DESCRIPTION OF THE PREFERRED EMBODIMENTS

Figure 1:
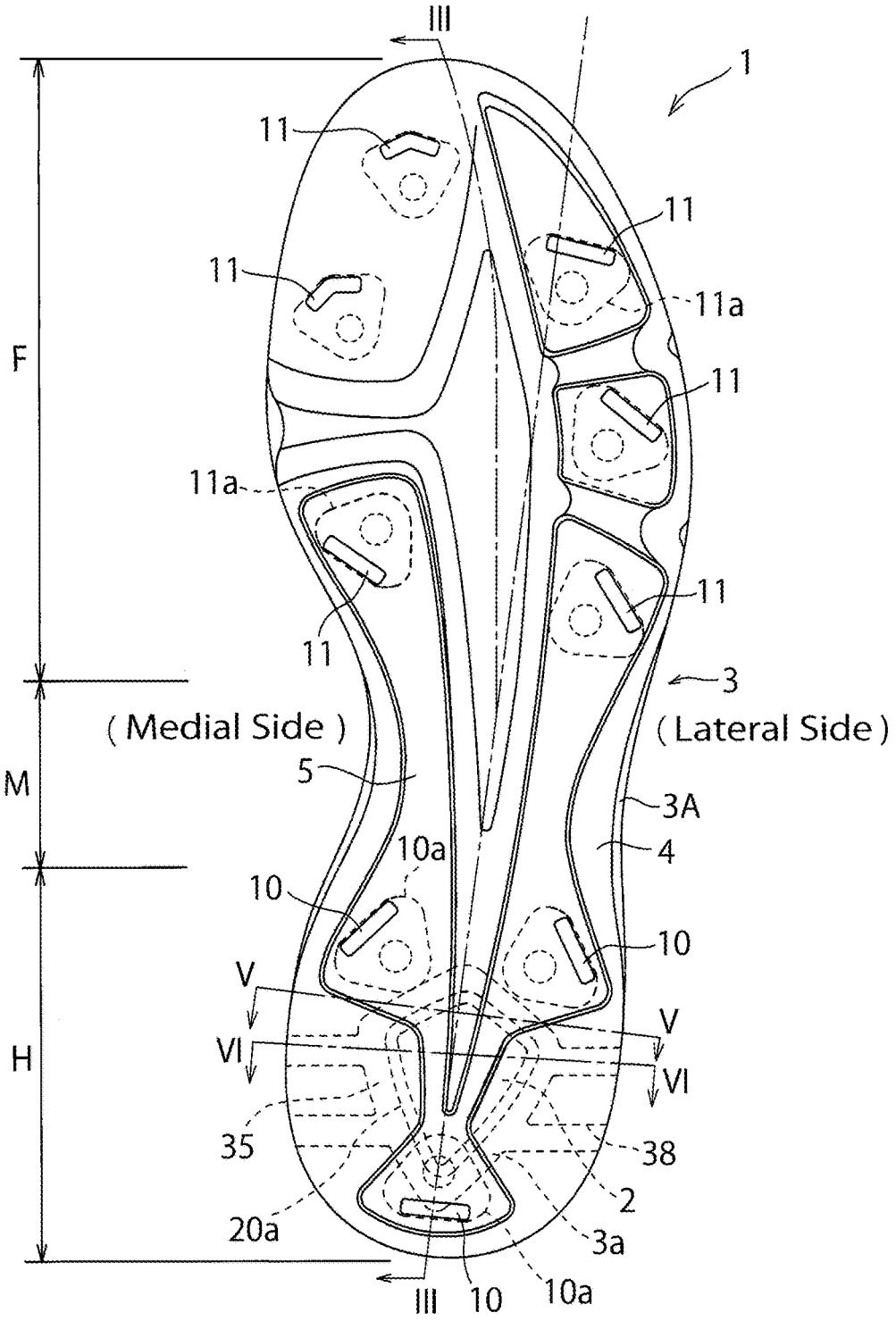
FIG. 1 is a bottom schematic view of a sole structure for a baseball spiked shoe (for a left foot) according to an embodiment of the present invention.

Referring now to the drawings, FIGS. 1 to 16 show a sole structure for a baseball spiked shoe according to an embodiment of the present invention. FIGS. 1 to 6 show the sole structure for the baseball spiked shoe for a left foot and FIGS. 7 to 16 show a simulation model and a simulation result of the present invention. In the following explanation, "forward (front side/front)" and "rearward (rear side/rear)" designate a forward direction and a rearward direction of a sole, respectively, "upward (upper side/upper)" and "downward (lower side/lower)" designate an upward direction and a downward direction of the sole, respectively, and "a width or lateral direction" designates a crosswise direction of the sole.

As shown in FIGS. 1 to 4, a sole structure 1 includes a first midsole 2 of a soft elastic member disposed at a generally mid portion of a heel region H (i.e. heel mid portion) of the shoe and a second midsole 3 of a soft elastic member disposed around the first midsole 2 via a deformed diamond-shaped circumferential groove 35. In this exemplification, the second midsole 3 extends from the heel region H through a midfoot region M to a forefoot region F of the shoe. The second midsole 3 includes a surface 30 located on a side of the sole of a shoe wearer's foot, a pair of upraised portions 31 extending upwardly on laterally opposite sides of the foot-sole-contact-side surface 30, an upraised portion 32 extending upwardly on a heel rear end side of the foot-sole-contact-side surface 30, and a bottom surface 3A located on a ground contact side. These upraised portions 31 and 32 are adapted to be fixedly attached to a bottom portion of an upper (not shown) of the shoe.

Figure 3:
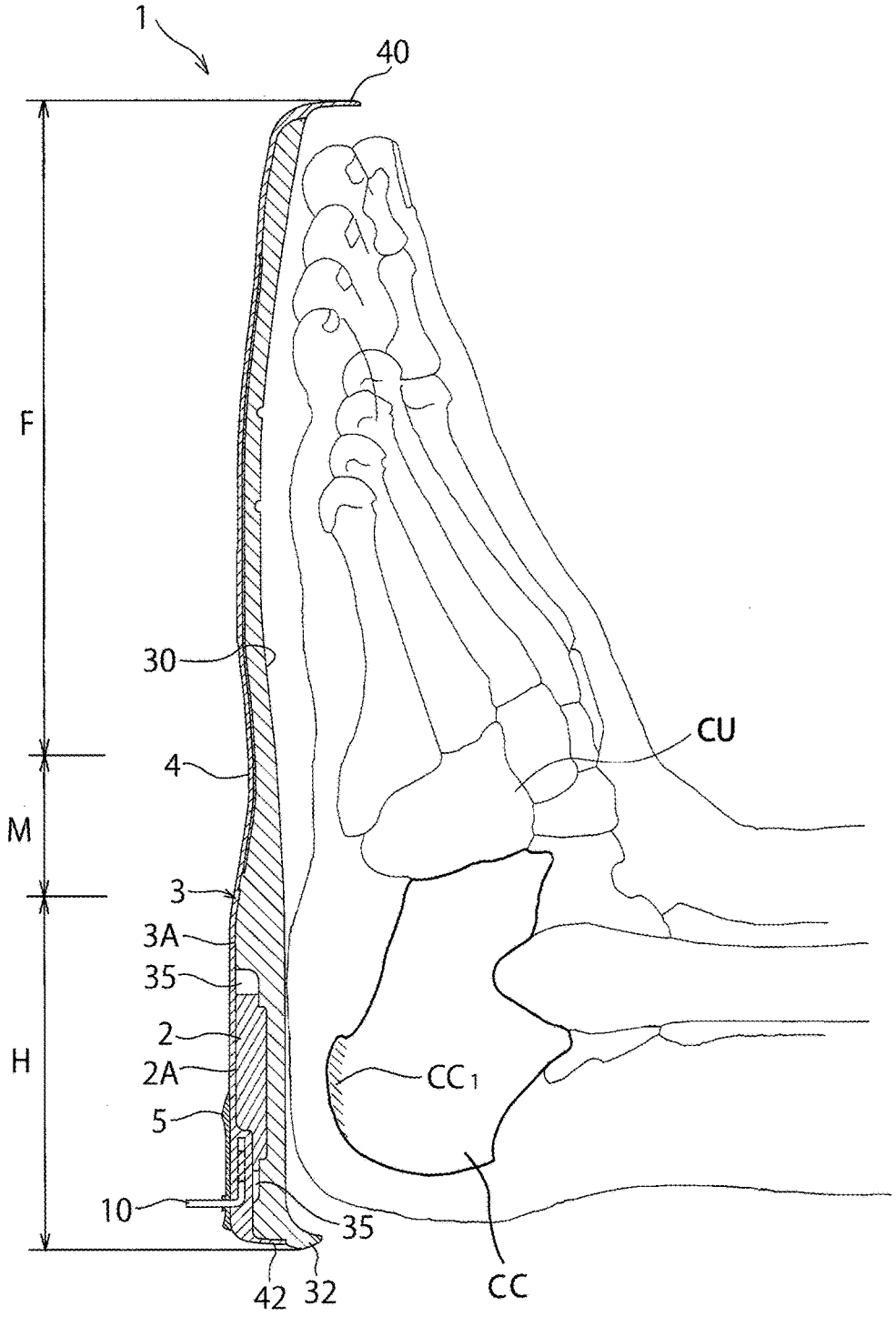
FIG. 3 is a longitudinal sectional view of FIG. 1 taken along line III-III, illustrating the sole structure together with an anatomical or bone structural view of a foot.
Figure 4:
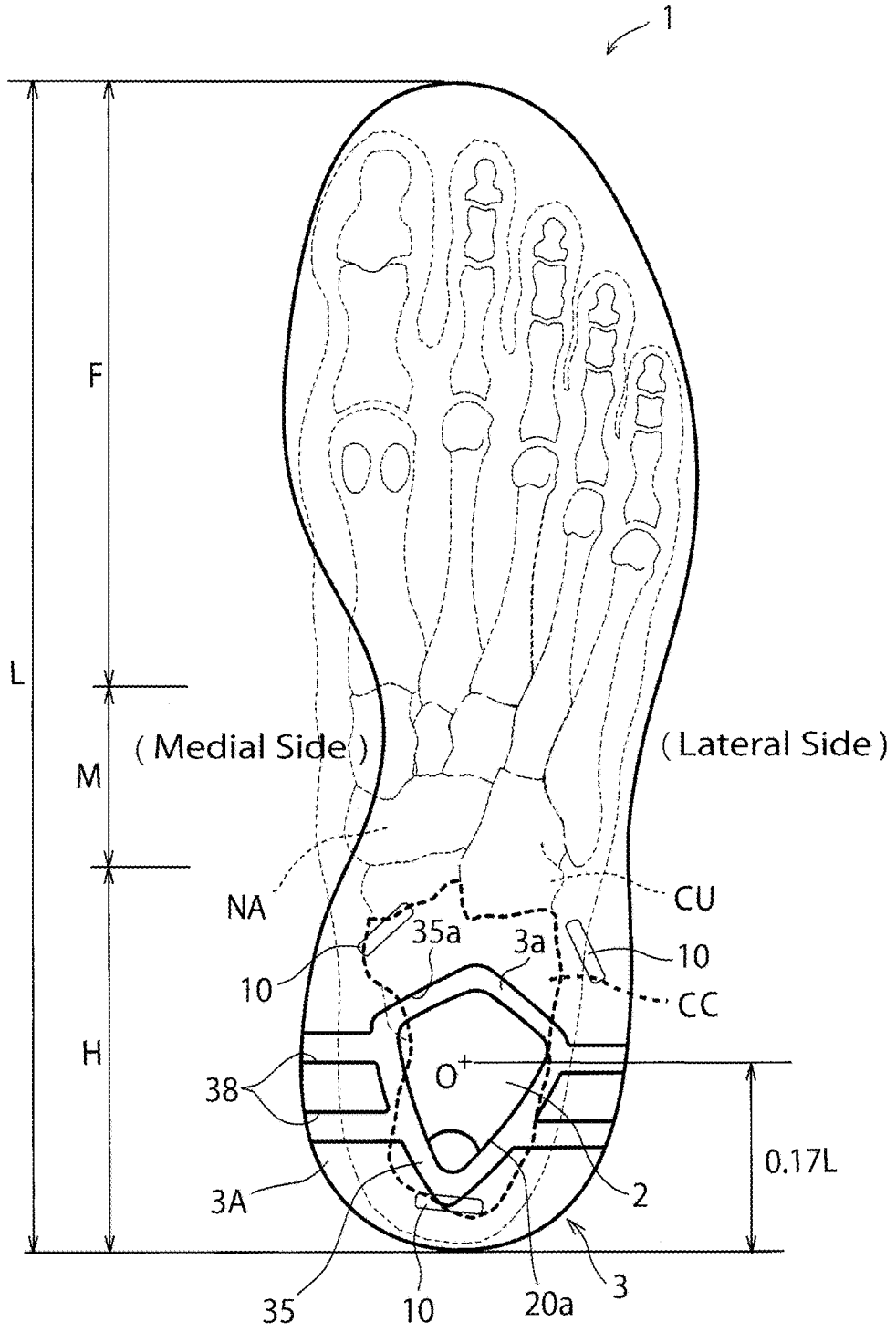
FIG. 4 is a bottom schematic view of only the midsole structure of the sole structure of FIG. 1, illustrating a state in which spikes and an outsole are removed from the sole structure of FIG. 1.
Figure 5:
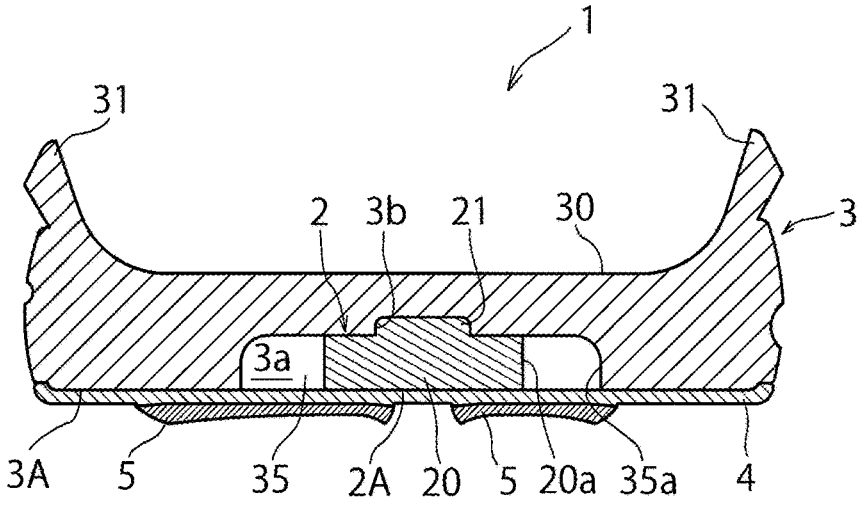
FIG. 5 is a cross sectional view of FIG. 1 taken along line V-V of FIG. 1.
Figure 6:
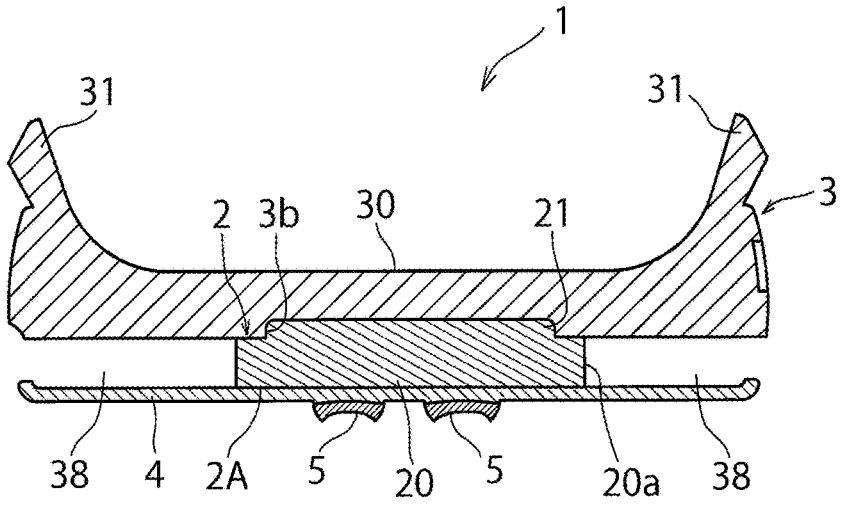
FIG. 6 is a cross sectional view of FIG. 1 taken along line VI-VI of FIG. 1.

As shown in FIGS. 4 and 5, the second midsole 3 has a cavity 3*a* formed therein at a heel mid portion of the bottom surface 3A to accommodate the first midsole 2. The cavity 3*a* has a small recess 3*b* formed at an upper portion of the cavity 3*a*. The first midsole 2 includes a body portion 20 disposed in the cavity 3*a* and a small protrusion 21 that protrudes from an upper surface of the body portion 20 and that is disposed in the recess 3*b*. The protrusion 21 of the first midsole 2 is fixedly attached to an interior of the recess 3*b* of the second midsole 3 through bonding, insert molding, two color molding or the like. There is formed a circumferential groove 35 by an outer circumferential surface 20*a* of the body portion 20 of the first midsole 2 and an inner circumferential surface 35*a* of the cavity 3*a* of the second midsole 3. In this exemplification, both the outer circumferential surface 20*a* of the body portion 20 of the first midsole 2 and the inner circumferential surface 35*a* of the cavity 3*a* of the second midsole 3 are deformed-diamond shaped. A width of the circumferential groove 35 is set to, for example 1 to 15 mm (preferably 3 to 10 mm) and a depth thereof is set to, for example 1.5 to 10 mm (preferably 3 to 8 mm). A bottom surface 2A of the first midsole 2 does not protrude downwardly from the bottom surface 3A of the second midsole 3 and the bottom surfaces 2A and 3A are generally flush with each other (see FIG. 3).

The first midsole 2 is disposed opposite a calcaneus CC of the foot as shown in FIG. 4, and more specifically, as shown in FIG. 3, the first midsole 2 is oppositely disposed to a bottom protruding portion $CC_1$ (hatched area) of the calcaneus CC. Additionally, in FIGS. 3 and 4, reference numbers CU and NA stand for a cuboid bone and a navicular bone, respectively. Also, in FIG. 4, point O designates a heel center of the foot, which is generally located at a position forward 0.17L (L: foot length) from the rearmost end of the calcaneus CC. The heel center O is, as shown in FIG. 4, positioned horizontally inside the outer periphery (e.g. outer circumferential surface 20*a*) of the first midsole 2.

Figure 2:
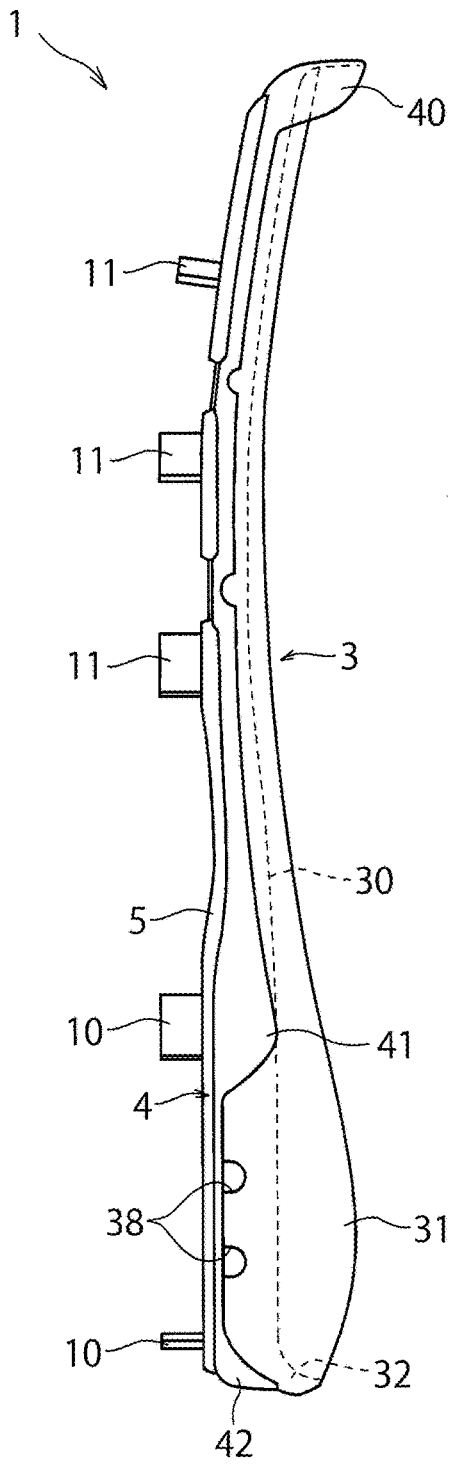
FIG. 2 is a lateral side view of the sole structure of FIG. 1.

As shown in FIGS. 1 to 3, the second midsole 3 has an outsole plate 4 of a hard elastic member disposed on the side of the bottom surface 3A. The outsole plate 4 is fixedly attached to the bottom surface 3A of the second midsole 3 by bonding or the like. The outsole plate 4 covers the bottom surface 2A of the first midsole 2, the circumferential groove 35, and the bottom surface 3A of at least a heel portion of the second midsole 3, e.g. as shown in FIGS. 1, 2, 3, 5 and 6. The outsole plate 4, in the illustrated exemplification, extends from the heel region H through the midfoot region M to the forefoot region F of the shoe. The outsole plate 4 has an upraised portion 40 extending upwardly at a toe portion, a pair of upraised portions 41 extending upwardly on opposite sides of the heel region H, and an upraised portion 42 extending upwardly on the rear end side of the heel region H. The upraised portion 40 is adapted to be fixedly attached to the bottom portion of the upper (not shown) and the upraised portions 41 and 42 are adapted to be fixedly attached to a heel side surface and a heel rear end surface of the first midsole 2, respectively.

The outsole plate 4 has a plurality of spikes or cleats 10, 11, as shown in FIGS. 1 to 3. The spikes 10 are disposed at the heel region H of the shoe and the spikes 11 at the forefoot region F. The spikes 10 and 11 are fixed to the outsole plate 4 through a mounting portion 10*a*, 11*a*, respectively. Also, the spikes 10, 11 adjacent to each other in the longitudinal direction are interconnected via a connection 5 extending between these longitudinally adjacent spikes 10, 11. In this example, three spikes 10 are provided at the heel region H, each of which encompasses i.e. outwardly surrounds an inner circumferential surface of the circumferential groove 35 (that is, an outer circumferential surface 20*a* of the body portion 20 of the first midsole 2), as shown in FIGS. 1 and 4. Thus, as shown in FIGS. 1 and 4, the three spikes are disposed at locations displaced horizontally outwardly away from the first midsole 2. Also, each of the spikes 10 is disposed at a position corresponding to an outer circumferential edge portion of the calcaneus CC.

The first and second midsoles 2, 3 are formed of soft elastic materials, more specifically, thermoplastic resin such as ethylene-vinyl acetate copolymer (EVA) and the like, foamed thermoplastic resin, thermosetting resin such as polyurethane (PU) and the like, foamed thermosetting resin, elastomers of these resin, rubber materials such as butadiene rubber, chloroprene rubber and the like, or foamed rubber materials. A hardness of the first midsole 2 is set to, for example 51-59C in the Asker C scale and a hardness of the second midsole 3 is set to, for example 48-56C in the Asker C scale. Preferably, the hardness of the first midsole 2 is lower than the hardness of the second midsole 3.

The outsole plate 4 is formed of a hard elastic member which has a greater hardness than the first and second midsoles 2, 3. More specifically, the outsole plate 4 is formed of thermoplastic resin such as thermo plastic polyurethane (TPU), polyamide (PA), polyamide elastomer (PAE), acrylonitrile-butadiene-styrene (ABS) resin and the like, or thermosetting resin such as epoxy resin, unsaturated polyester resin and the like.

The second midsole 3 has a lateral through hole 38 formed therein at the heel portion, which penetrates through the interior of the second midsole 3 from the medial and lateral sides to the circumferential groove 35, as shown in FIGS. 1, 2, 4 and 6. In this example, two through holes 38 are provided. These through holes 38 are employed mainly for the aesthetic standpoint. The first midsole 2 inside the shoe can be seen through these through holes 38 from the medial and lateral sides of the shoe.

Figure 7:
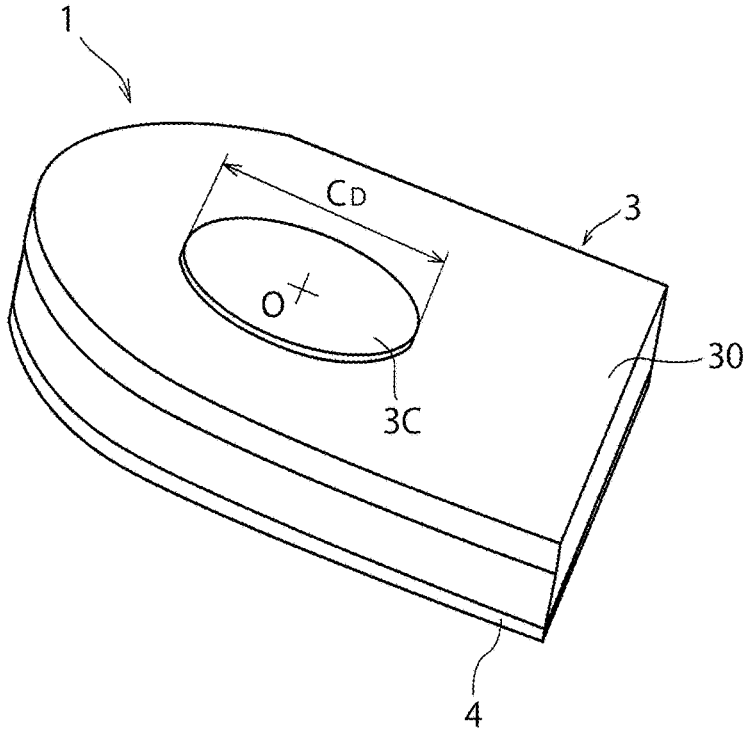
FIG. 7 is an upper side perspective view of a heel portion of the sole structure, which is a simulation model for analysis of the present invention, showing a calcaneus corresponding area in a mid region on an upper surface of a second midsole.
Figure 8:
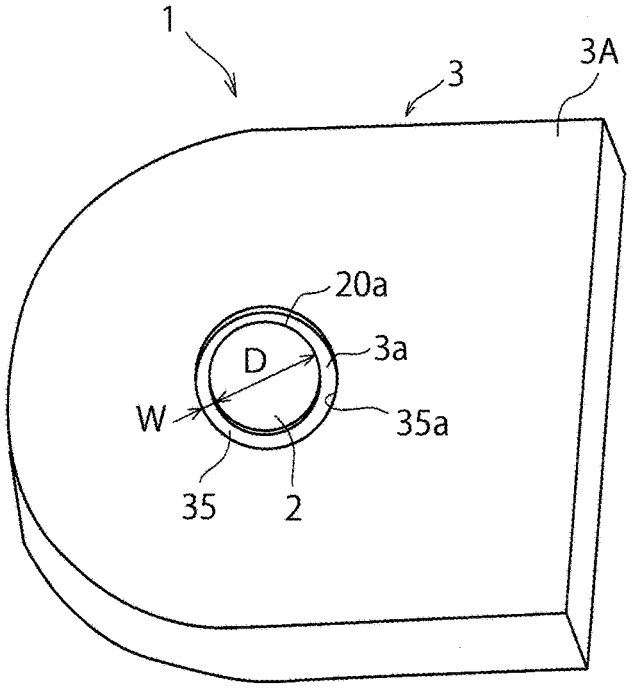
FIG. 8 is a lower side perspective view of a midsole structure of FIG. 7, showing a first midsole and an annular groove around the first midsole in a mid region on a lower surface of the second midsole.
Figure 9:
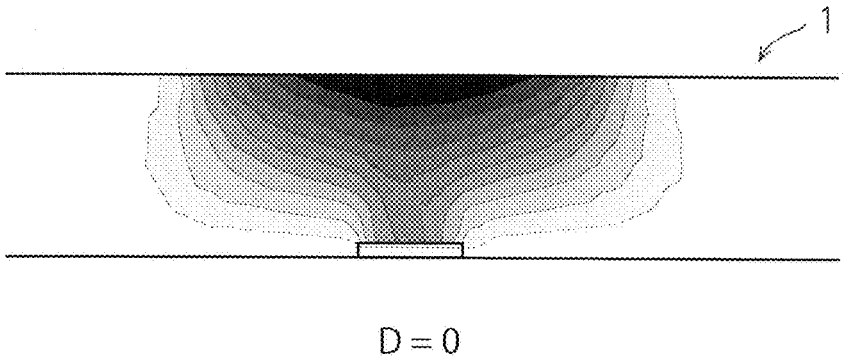
FIG. 9 is a strain distribution diagram inside the sole structure along with a longitudinal section of the sole structure, illustrating the simulation result in the case that an inner diameter of the annular groove is 0.
Figure 10:
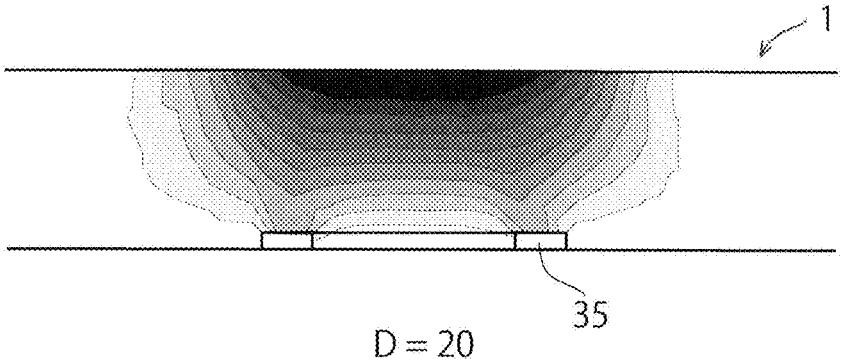
FIG. 10 is a strain distribution diagram inside the sole structure along with the longitudinal section of the sole structure, illustrating the simulation result in the case that the inner diameter of the annular groove is 20 mm.
Figure 11:
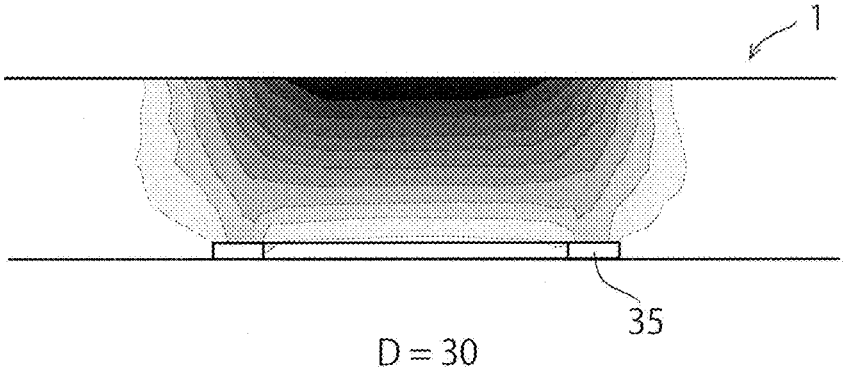
FIG. 11 is a strain distribution diagram inside the sole structure along with the longitudinal section of the sole structure, illustrating the simulation result in the case that the inner diameter of the annular groove is 30 mm.

Then, the detailed position and the size (inner diameter) of the circumferential groove 35 will be verified through simulation. FIGS. 7 and 8 show a heel portion of a sole structure as a simulation model, and FIGS. 9 to 16 show the result of the simulation. In these drawings, the same reference numbers as those of the portions of the above-mentioned sole structure 1 indicate identical or corresponding parts.

As shown in FIGS. 7 and 8, the sole structure 1 is formed of the first and second midsoles 2, 3 and the outsole plate 4. In FIG. 7, the upper side of the sole structure 1 is shown. In FIG. 8, the lower side of the sole structure is shown and FIG. 8 shows the state that the outsole plate 4 is removed. As shown in FIG. 7, the second midsole 3 has a calcaneus corresponding area 3C on the foot-sole-contact-side surface 30 thereof. The calcaneus corresponding area 3C is a circular region with a heel center O as a center and with a diameter $C_D$ of 40 mm. As shown in FIG. 8, on the bottom surface 3A of the second midsole 3, a circumferential groove 35, an annular groove whose center is located at the position corresponding to the heel center O of the foot-sole-contact-side surface 30. The circumferential groove 35 is composed of an inner circumferential surface 35*a* of a cylindrical shape of the cavity 3*a* formed on the bottom surface 3A of the second midsole 3, and an outer circumferential surface 20*a* of a cylindrical shape of the column-shaped first midsole 2 received in the cavity 3*a*. Here, a width W of the circumferential groove 35 is set to 5 mm and a depth thereof is set to 1.5 mm. As the inner diameter D of the circumferential groove 35 (i.e. a diameter of the outer circumferential surface 20*a*) changes, when a predetermined load is applied to the calcaneus corresponding area 3C, a strain distribution and a deformation inside the sole structure 1 will be calculated.

Figure 12:
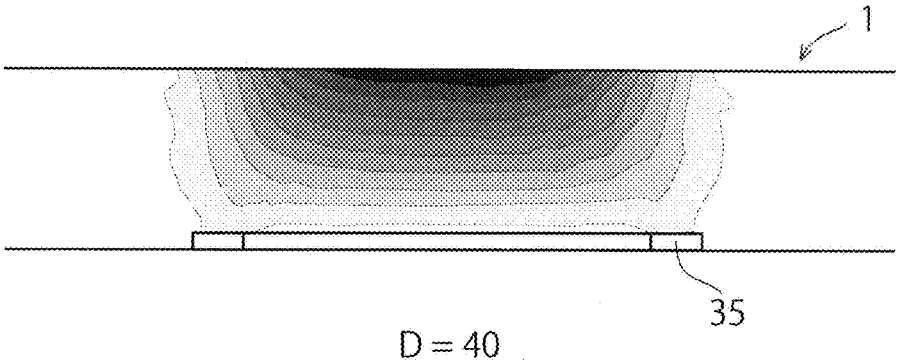
FIG. 12 is a strain distribution diagram inside the sole structure along with the longitudinal section of the sole structure, illustrating the simulation result in the case that the inner diameter of the annular groove is 40 mm.
Figure 13:
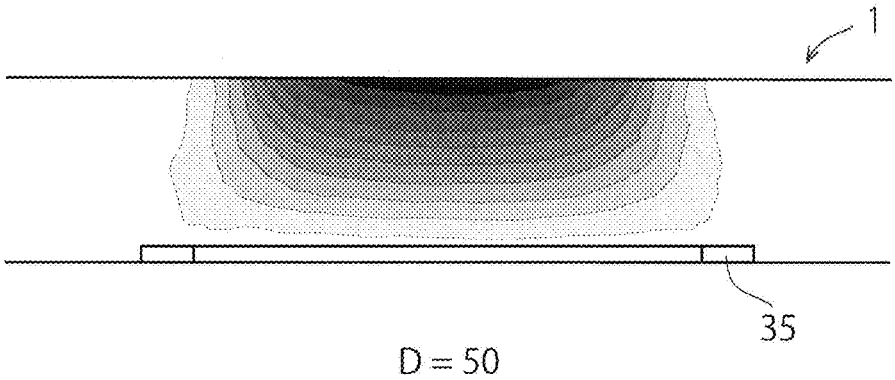
FIG. 13 is a strain distribution diagram inside the sole structure along with the longitudinal section of the sole structure, illustrating the simulation result in the case that the inner diameter of the annular groove is 50 mm.
Figure 14:
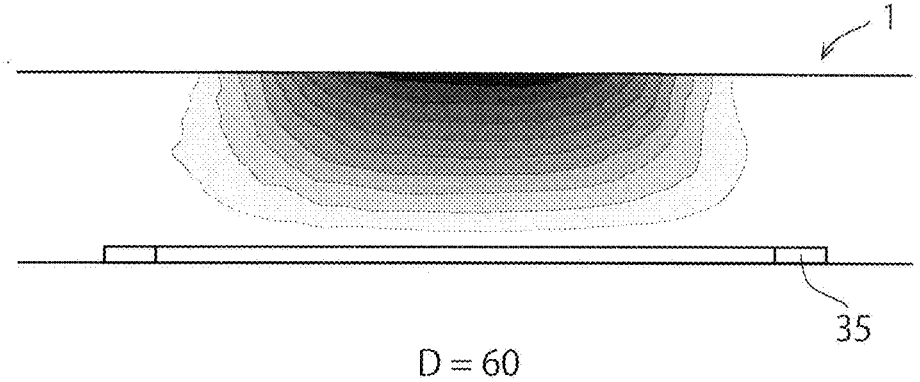
FIG. 14 is a strain distribution diagram inside the sole structure along with the longitudinal section of the sole structure, illustrating the simulation result in the case that the inner diameter of the annular groove is 60 mm.
Figure 15:
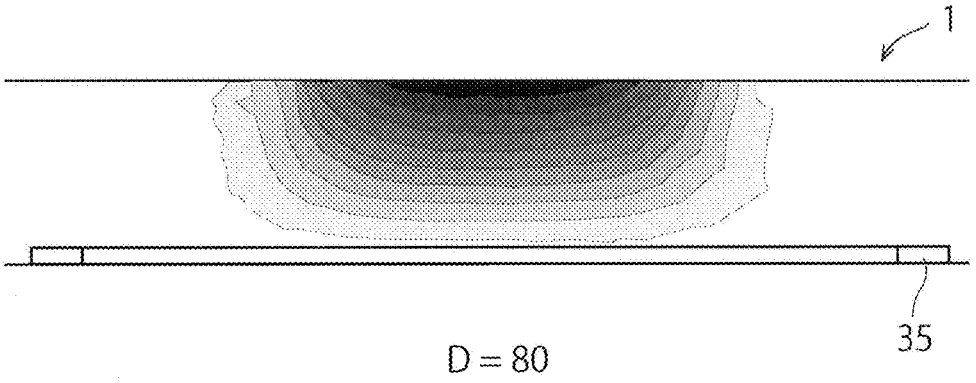
FIG. 15 is a strain distribution diagram inside the sole structure along with the longitudinal section of the sole structure, illustrating the simulation result in the case that the inner diameter of the annular groove is 80 mm.

FIGS. 9 to 15 show a strain distribution of the interior of the sole structure 1 and in each of the drawings, the deeper the color is, the greater the strain is. In the case of D=0 (that is, the inner diameter of the circumferential groove 35 is 0, namely, one groove (or hole) exists in the center) shown in FIG. 9 and in the case of D<0 (that is, the inner diameter of the circumferential groove 35 is smaller than the diameter $C_D$(=40 mm) of the calcaneus corresponding area 3C), a region of greater strain extends to the ground contact surface at an inside region of the calcaneus corresponding area 3C (especially, at and near the circumferential groove 35), deformation at the inside region of the calcaneus corresponding area 3C is large, and it can thus be said that deformation concentrates in this inside region. On the other hand, in the case of D=40 and D=50 (that is, the inner diameter of the circumferential groove 35 is equal to or greater than the diameter $C_D$ (=40 mm) of the calcaneus corresponding area 3C) as shown in FIGS. 12 and 13, strain is dispersed throughout the entire calcaneus corresponding area 3C (and also the entire inside region in the vicinity of the circumferential groove 35) without concentrating in the inside region of the calcaneus corresponding area 3C. In the case of D=60 and D=80 (that is, the inner diameter of the circumferential groove 35 is considerably greater than the diameter $C_D$ (=40 mm) of the calcaneus corresponding area 3C) as shown in FIGS. 14 and 15, strain is not distributed near the circumferential groove 35 and strain distribution has hardly changed from the state of D=50. In these cases, it can be said that the circumferential groove 35 hardly influences the strain distribution.

Figure 16:
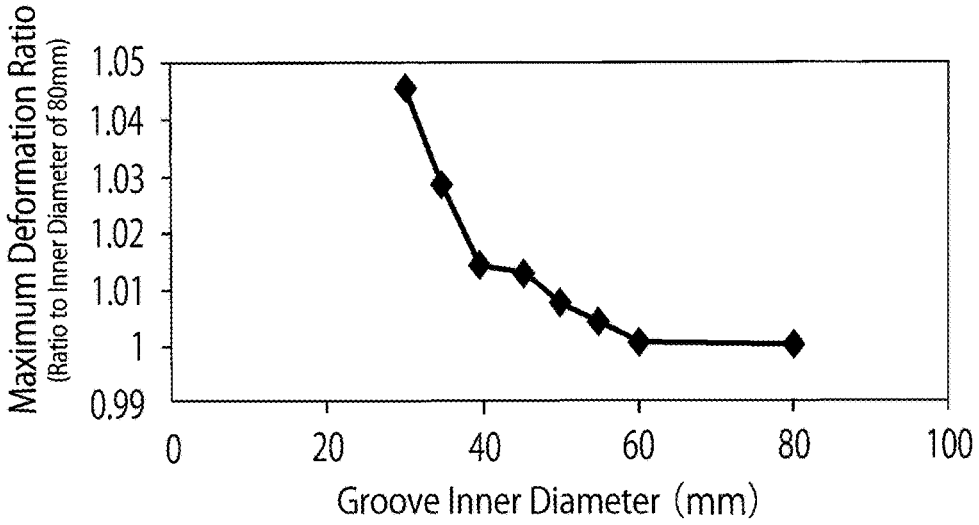
FIG. 16 is a graph illustrating a relation between the inner diameter of the annular groove (i.e. groove inner diameter) and the maximum deformation ratio (ratio to the inner diameter of 80 mm) in the simulation result.

FIG. 16 is a graph showing deformation of the sole structure 1, in which the horizontal axis designates the inner diameter D of the circumferential groove 35 (i.e. the groove inner diameter) and the vertical axis designates the maximum deformation ratio relative to the case that the maximum deformation at D=80 mm is equal to 1. As shown in FIG. 16, in the region of D<40, the maximum deformation ratio drastically increases as the inner diameter D decreases and a drastic increase in the maximum deformation is found. That is because a large deformation occurs at the inside region of the calcaneus corresponding area 3C as above-mentioned and deformation concentrates in the inside region. In this case, it can be said that the midsole loses its elasticity and cushioning properties thereof decrease. Also, in the region of 40≤D<60, the maximum deformation ratio gradually decreases as the inner diameter D increases and a gradual decrease in the maximum deformation is found. In this region, it can be said that moderate cushioning properties are obtained. On the other hand, in the region of 60≤D<80, the maximum deformation ratio does not change even when the inner diameter D increases and it is thus found that the size of the inner diameter D does not influence the cushioning properties.

When considering the result of the aforementioned strain distribution diagram and the deformation graph, a preferable value of the inner diameter D is 40≤D<60.

According to the above-mentioned embodiment, since the first midsole 2 is disposed at the heel central portion of the second midsole 3 with the circumferential groove 35 formed between the first midsole 2 and the second midsole 3, when the heel of the shoe strikes onto the ground, a load from the heel portion of the shoe wearer's foot is imparted to the first and second midsoles 2, 3 with the spikes 10 of the outsole plate 4 contacted with the ground and the heel region H of the shoe supported. At this moment, the first midsole 2 disposed at the heel central portion of the shoe expands outwardly e.g. horizontally toward the circumferential groove 35 to compressively deform, thereby absorbing an impact force at the time of striking onto the ground, improving cushioning properties of the heel region H of the shoe, and thus enhancing comfortableness in wearing the shoe. In this embodiment, the entire sole structure can be simplified by merely separating the first midsole 2 at the heel central portion from the second midsole 3 around the first midsole 2 via the circumferential groove 35. Moreover, in the present embodiment, since the first midsole 2 is fixedly attached to and integrated with the second midsole 3, when the first midsole 2 deforms, a fall-off, a protrusion or the like of the first midsole 2 from the second midsole 3 can be securely prevented without any special structures.

First Alternative Embodiment

In the above-mentioned embodiment, an example was shown in which the circumferential groove 35 has a deformed diamond shape or a diamond-like shape, but the shape of the circumferential groove 35 is not limited to such a shape. Other square shapes including a rectangular shape, a trapezoidal shape or the like, a triangular shape, or polygonal shape may be applied. Alternatively, a curved shape such as an elongated round shape, an elliptical or oval shape, a round shape or the like may also be applied. Any suitable shapes can be employed according to the position or the like of the spikes.

Second Alternative Embodiment

In the above-mentioned embodiment, an example was shown in which the circumferential groove 35 is an annular groove that extends along the entire periphery around the position corresponding to the heel center O, but the present invention is not limited to such an embodiment. The circumferential groove 35 may be formed of a plurality of grooves that extends linearly or curvedly around the position corresponding to the heel center O. In these cases, at a region located between the circumferentially adjacent grooves, the first and second midsoles 2, 3 are interconnected to each other.

Third Alternative Embodiment

In the above-mentioned embodiment, an example was shown in which the second midsole 3 extends from the heel region H to the forefoot region F, but the second midsole 3 has only to be disposed at least at the heel region H.

Fourth Alternative Embodiment

In the above-mentioned embodiment, as a preferred embodiment, an example was shown in which the hardness of the first midsole 2 is smaller than the hardness of the second midsole 3, but the hardness of the first midsole 2 may be substantially equal to the hardness of the second midsole 3.

Fifth Alternative Embodiment

In the above-mentioned embodiment, an example was shown in which three spikes were provided at the heel portion of the shoe, but the number of the spikes is not limited to such an embodiment. For example, two spikes may be employed.

Sixth Alternative Embodiment

In the above-mentioned embodiment, an example was shown in which the first midsole 2 was provided discretely from the second midsole 3 and the first and second midsoles 2 and 3 were integrated with each other by fixedly attaching the first midsole 2 to the second midsole 3, but application of the present invention is not limited to such an embodiment. The first midsole 2 may be unitary as one unit with the second midsole 3. That is to say, the first and second midsoles 2 and 3 are overall formed of a single midsole and by forming the circumferential groove 35 on the single midsole, the single midsole is separated into two sections, a section of the first midsole 2 and the other section of the second midsole 3.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A sole structure for a baseball spiked shoe comprising:

a first midsole disposed at a heel central portion of a heel portion of said sole structure;

a second midsole that is disposed at least at said heel portion around and horizontally away from said first midsole via a circumferential groove provided therebetween, and that is integrally formed with or unitary as one unit with said first midsole;

an outsole plate that is disposed under and covers a lower surface of said first midsole and a lower surface of said second midsole, and that has a hardness greater than a hardness of said first midsole and greater than a hardness of said second midsole; and a plurality of spikes that are fixed to said outsole plate, and that protrude downwardly from a bottom surface of said outsole plate;

wherein said lower surface of said first midsole is flush with said lower surface of said second midsole; and wherein said spikes are disposed horizontally away from said first midsole.

2. The sole structure according to claim 1, wherein said first midsole is integrated with and received by said second midsole in a cavity formed in said lower surface of said second midsole, and said circumferential groove is bounded by an outer circumferential surface of said first midsole and an inner circumferential surface of said cavity of said second midsole.

3. The sole structure according to claim 1, wherein said first midsole is located at a position adapted to correspond to a bottom protruding portion of a calcaneus of a shoe wearer's foot.

4. The sole structure according to claim 1, wherein an inner circumferential surface of said circumferential groove is positioned at a region of a concentric circle with a center position adapted to correspond to a heel center of a shoe wearer's foot as a center of the concentric circle and with a diameter of at least 40 mm and less than 60 mm.

5. The sole structure according to claim 4, wherein said circumferential groove is an annular groove that extends along an entire periphery around said center position.

6. The sole structure according to claim 4, wherein said circumferential groove is formed of a plurality of grooves that extend linearly or curvedly around said center position.

7. The sole structure according to claim 1, wherein said hardness of said first midsole is lower than said hardness of said second midsole.

8. A sole structure for a shoe, comprising:

a second midsole at a heel portion of said sole structure, with a cavity recessed into a lower surface of said second midsole;

a first midsole arranged within said cavity, wherein said first midsole and said second midsole are unitary with one another as one single member, a lower surface of said first midsole is flush with said lower surface of said second midsole, and a perimeter groove is formed by said cavity between an outer perimeter wall of said first midsole and an inner perimeter wall of said second midsole bounding said cavity;

an outsole plate that is arranged under and covers said lower surface of said first midsole and said lower surface of said second midsole, wherein said outsole plate has a hardness greater than a hardness of said first midsole and greater than a hardness of said second midsole; and spikes protruding downwardly from a bottom surface of said outsole plate at locations displaced horizontally away from said first midsole.

9. The sole structure according to claim 8, wherein said cavity in said second midsole includes a main cavity portion and a recess that extends upwardly into said second midsole from an upper end of said main cavity portion, said recess has a smaller height and a smaller width than said main cavity portion, and said first midsole includes a first midsole main body portion that is received in said main cavity portion and a first midsole protrusion that protrudes upwardly from said first midsole main body portion and that is received in said recess.

10. The sole structure according to claim 8, wherein a horizontal dimension of said first midsole is at least 40 mm and less than 60 mm.

* * * * *